United States Patent [19]

Osmond

[11] Patent Number: 4,708,290

[45] Date of Patent: Nov. 24, 1987

[54] LAWN SPRINKLERS FOR LAWNS

[75] Inventor: Dennis R. C. Osmond, St Albans, England

[73] Assignee: Hozelock-ASL Limited, Buckinghamshire, England

[21] Appl. No.: 700,186

[22] Filed: Feb. 11, 1985

[30] Foreign Application Priority Data

Feb. 21, 1984 [GB] United Kingdom ..... 8404490

[51] Int. Cl.[4] ..... B05B 3/04

[52] U.S. Cl. ..... 239/227; 74/799; 74/800; 239/240

[58] Field of Search ..... 239/222.15, DIG. 1, 239/240–242, 225, 206, 219.13, 227; 74/799, 800, 785

[56] References Cited

U.S. PATENT DOCUMENTS

| | | | |
|---|---|---|---|
| 928,386 | 7/1909 | Johnson | 239/240 X |
| 2,138,282 | 11/1938 | Lanninger | 239/240 X |
| 2,475,537 | 7/1949 | Ashworth | 239/240 X |
| 2,824,765 | 2/1958 | Stangle et al. | 239/DIG. 1 X |
| 3,244,373 | 4/1966 | Hart | 239/240 X |
| 3,608,828 | 9/1971 | Tokar | 239/240 |

FOREIGN PATENT DOCUMENTS

| | | | |
|---|---|---|---|
| 2551842 | 5/1977 | Fed. Rep. of Germany | 74/799 |

*Primary Examiner*—Andres Kashnikow
*Assistant Examiner*—Kevin Weldon
*Attorney, Agent, or Firm*—Penrose Lucas Albright Pravel, Gambrell, Hewitt, & Kimball

[57] ABSTRACT

A water sprinkler comprises a body (15) housing a rotor (1) which is rotatably driven about a central vertical axis by water which enters the body by an inlet (12). Water leaves the body (15) by a hollow distribution shaft (5) having at its upper end a water discharge nozzle (14). The shaft (5) extends at an angle to the vertical and is rotationally driven about the central vertical axis by an epicyclic drive mechanism comprising a pinion rotatable with the rotor (1), a ring rear (11) formed on the internal wall of the body (15) and a planet gear (7). The planet gear meshes both with the pinion and the ring gear and is attached to one end of the hollow distribution shaft.

10 Claims, 4 Drawing Figures

LAWN SPRINKLERS FOR LAWNS

SUMMARY OF THE INVENTION

This invention relates to water sprinklers, for lawns, tennis courts etc of the kind which includes a mechanism whereby the area covered by the sprinkler is continuously changed during use.

According to this invention a water sprinkler comprises a body, a rotor which is rotatably mounted within the body to be driven by incoming water, a hollow distribution shaft which is inclined to the vertical axis and is mounted to rotate with respect to the body about a vertical axis, and drive means which transmit drive from the rotor to the hollow distribtuion shaft to rotate the latter about the vertical axis as water issues from an upper end of the shaft.

Conveniently, the drive means rotate the distribution shaft about its own inclined axis, simultaneously with the rotation of the distribution shaft about the vertical axis. Preferably, the drive means comprise an epicyclic gear mechanism including a pinion mounted to rotate with the rotor, a planet gear rotatable with the distribution shaft and an outer ring gear on the internal wall of the body, the planet gear meshing both with the pinion and the outer ring gear.

The direction and strength of the water issuing from the upper end of the distribution shaft may be determined by the shape, dimensions and/or number of bores, of a selected spray nozzle, which may be detachably fitted to the distribution shaft.

In order that the invention may be readily understood, and further features may be apparent, one embodiment of water sprinkler will now be described, with reference to the accompanying drawings in which:

DESCRIPTION OF THE PREFERRED EMBODIMENT

Figure 1:
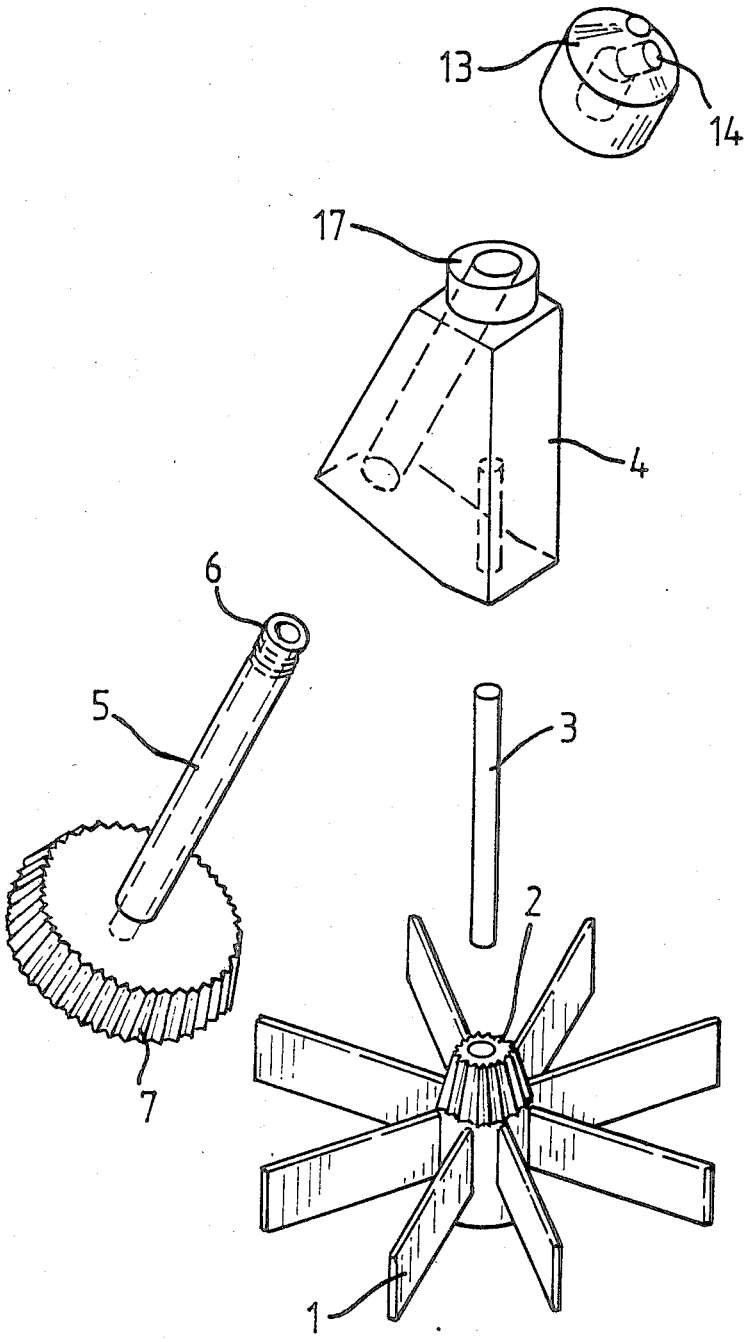
FIG. 1 is an exploded, perspective view of the components of the sprinkler.
Figure 2:
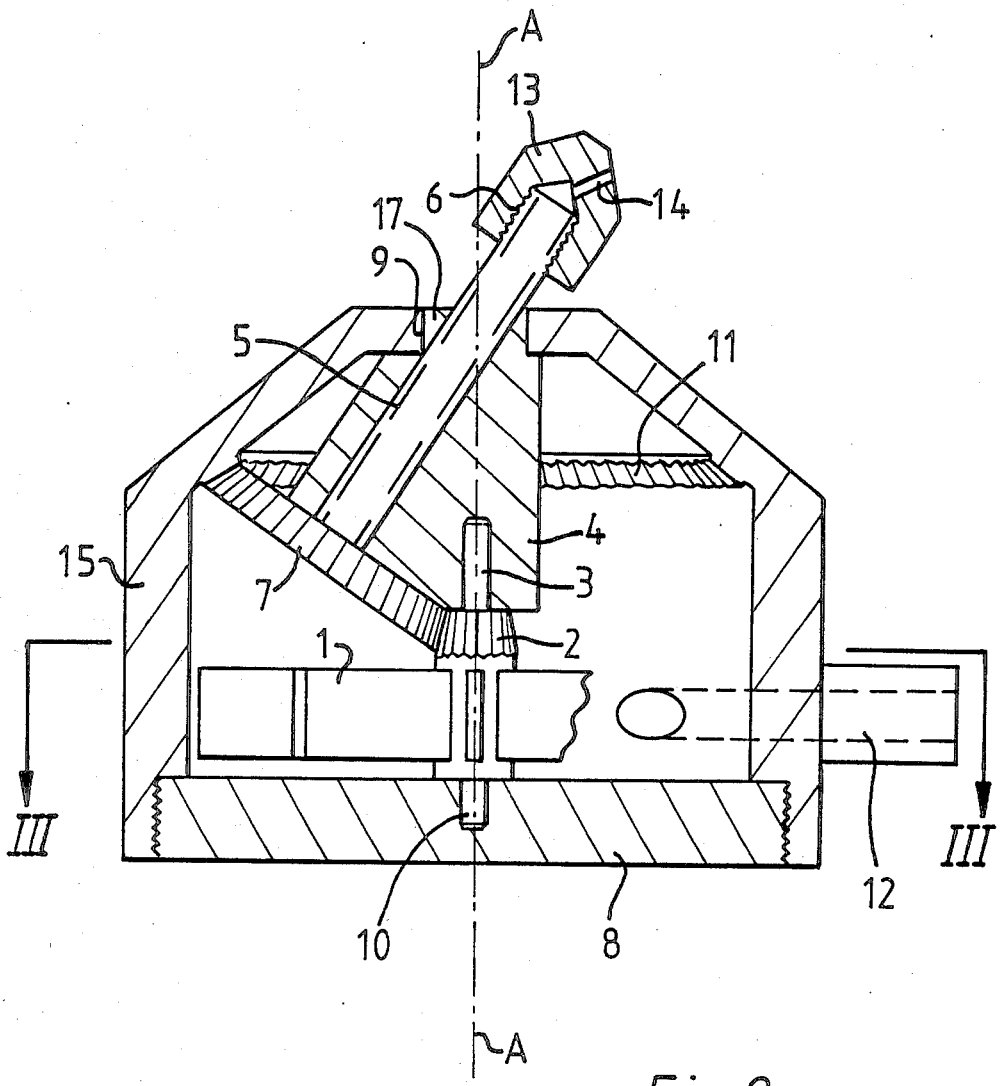
FIG. 2 is a cross-sectional elevation of the assembled sprinkler.

Referring to the drawings, the sprinkler generally comprises a circular, cylindrical body 15 (see FIG. 2) which houses a vaned rotor (or impeller) 1. The uppermost end of a hub of the rotor 1 fixedly carries a beveled pinion 2. The rotor 1 is free to rotate about a central vertical axis A—A on an axle 3 which depends from a carrier 4. A hollow distribution shaft 5, which is threaded at its uppermost end 6, is carried by the carrier 4 and has at its lower end a beveled planet gear 7 arranged to mesh with the pinion 2. The shaft 5 is free to rotate in the carrier 4 about an axis inclined at 45° C. to the vertical axis A—A. The carrier 4 is free to rotate about the vertical axis A—A between (at its lower end) the axle 3 and (at its top face) a bearing boss 17.

A drive mechanism for the sprinkler is in the form of an epicyclic bevel gear and consists of the beveled pinion 2, the beveled planet gear 7 and an outer ring gear 11 centered on the axis A—A. The ring gear 11 has internally projecting beveled teeth which are formed as an integral part of the body 15. The drive mechanism is enclosed within the body 15 by a base closure plate 8.

The top of the body has a bearing aperture 9, which allows free rotation of the boss 17 of the carrier 4, and the base closure plate 8 has a blind bearing 10 which allows free rotation of the lower end of the axle 3. The shaft 5 has a central flow passage which, at the lower end of the shaft 5, communicates with the interior of the body 15 through a central aperture in the bevel gear 7. The shaft 5 extends across the vertical axis A—A.

Figure 3:
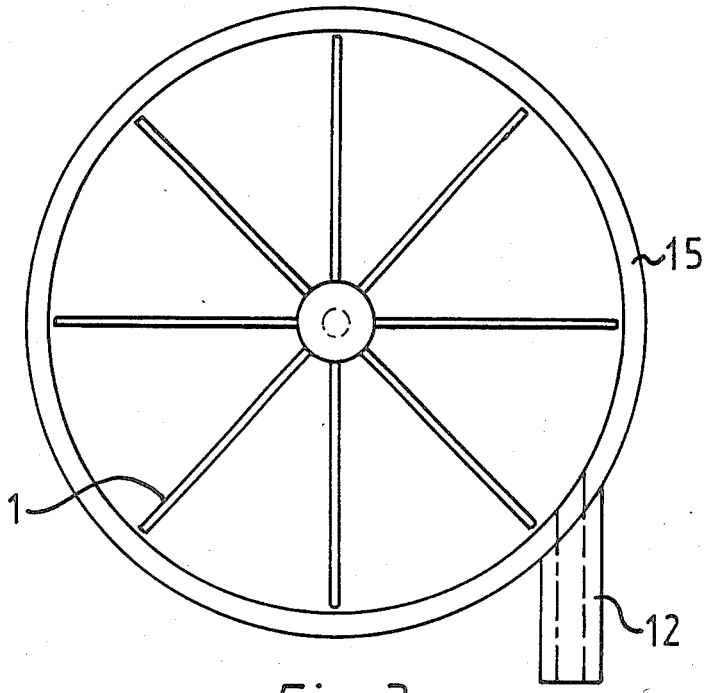
FIG. 3 is a section on the line III—III of FIG. 1.

The body 15 also has a water inlet at 12 which is positioned tangentially to the rotor 1 (see FIG. 3). When assembled, a nozzle 13 is fitted to the threaded end 6 of the distribution shaft 5 and, as will be apparent from FIG. 2, this nozzle has an outlet jet 14 positioned at an angle of 22.5° C. from the central longitudinal axis of the shaft 5.

Figure 4:
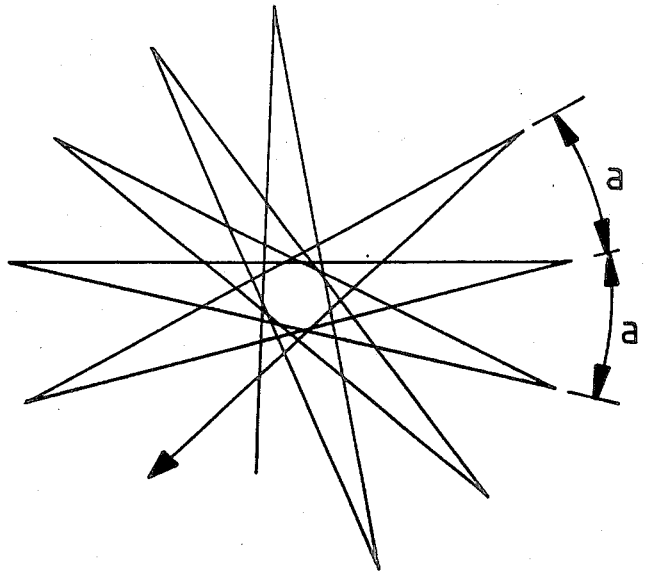
FIG. 4 is a diagrammatic representation of a spray pattern followed by the sprinkler, in use.

In operation of the sprinkler, water enters via inlet 12 and emits via outlet jet 14. The inflow of water causes the vaned rotor 1 to rotate, which causes distribution shaft 5 to rotate about its own, inclined, axis. The outlet jet sprays a conical pattern between the vertical and 67.5°, while at the same time the engagement between the planet gear 7 and the outer ring gear 11 causes the carrier 4 to rotate about the vertical axis A—A, thereby moving the distribution shaft 5 bodily around said vertical axis. Thus, the spray pattern generated by both these movements will be generally as shown in FIG. 4, or a modified form of that pattern, depending upon the variables used.

A typical epicyclic gear train could be -

(a) No of teeth in pinion 2=10

(b) No of teeth in planet 7=50

(c) No of teeth in outer ring gear 11=101

This would create the pattern shown in FIG. 4 and provides a regular, set, angular displacement of the nozzle 13 (and hence between the peaks "a" of the pattern) of 1/100th of a revolution, or 3.6°.

It should be noted that (c) should not be a multiple of (b). Ideally (c) should be a prime number. Were (c) to be a multiple of (b), a simple repeat pattern would occur, and uneven sprinkling would result.

It will be appreciated that for maximum distance thrown by the water jet, and hence maximum area coverage a single nozzle may be used, but for smaller areas and finer spray, a multiple jet nozzle may be used.

All components of the sprinkler may be moulded from a synthetic plastics material.

Having disclosed my invention, what is claimed as new and to be secured by Letters Patent of the United States is:

1. A lawn sprinkler having a body with an inlet for admitting water to an interior of said body, a rotor mounted to rotate about a vertical axis in the base of said body, a pinion disposed within said body above said rotor and rotatable with said rotor about the said vertical axis, a stationary horizontal ring gear on an internal wall of said body which is disposed above said pinion so that said vertical axis coincides with the central axis of symmetry of said ring gear, a beveled planet gear which meshes both with said ring gear and said pinion and which is at an angle of inclination to the horizontal, said planet gear having a central aperture, a hollow distribution shaft extending at said angle of inclination with respect to the vertical from a lower end at which said distribution shaft is coaxially attached to said planet gear and communicates by means of said central aperture in said planet gear with the interior of said body, and an upper end which projects upwardly from said body and has an outlet nozzle for the delivery of water, a carrier which is rotatably mounted about the vertical axis and which rotatably supports said distribution shaft for rotation of the latter about its inclined axis, the arrangement of the foregoing elements being such that water entering said inlet impinges upon and rotatably drives said rotor which in turn drives said planet gear to cause said distribution shaft to rotate about its own inclined axis with respect to said carrier and simultaneously to rotate about said vertical axis with said carrier as water passes from the interior of said body, through said central aperture in said planet gear, upwardly through said distribution shaft to emerge as an outlet jet or spray from said nozzle.

2. A sprinkler according to claim 1, wherein the number of teeth on said outer ring gear is greater than the number of teeth on said planet gear but is not a multiple thereof, and the outlet nozzle is angled with respect to the hollow distribution shaft whereby when the distribution shaft momentarily points in the same direction in successive revolutions of the distribution shaft about said vertical axis, said nozzle points in differing directions and thus applies water to different regions of the lawn on said successive revolutions.

3. A sprinkler according to claim 11, wherein said body has an upper aperture through which said distribution shaft extends, said upper aperture forming a rotational bearing for the upper end of said carrier.

4. A sprinkler according to claim 3, wherein said carrier is rotatably mounted on an axle projecting upwardly from said pinion.

5. A sprinkler according to claim 1, wherein said distribution shaft crosses said vertical axis.

6. A sprinkler according to claim 1, wherein the number of teeth on said ring gear is more than twice the number of teeth on said planet gear.

7. A sprinkler according to claim 1, wherein the number of teeth on said ring gear is 101 and the number of teeth on said planet gear is 50.

8. A sprinkler according to claim 1, whose number of teeth on said ring gear is a prime number.

9. A sprinkler according to claim 1 wherein said nozzle directs spray at an angle relative to the longitudinal axis of said distribution shaft.

10. A sprinkler according to claim 1 wherein substantially all of said nozzle is on the opposite side of said vertical axis relative to said planet gear.

* * * * *